US011268048B2

(12) United States Patent
Barreleiro et al.

(10) Patent No.: US 11,268,048 B2
(45) Date of Patent: Mar. 8, 2022

(54) COATED GRANULES, USE THEREOF, AND WASHING AND CLEANING AGENTS CONTAINING SAME

(71) Applicant: WeylChem Wiesbaden GmbH, Wiesbaden (DE)

(72) Inventors: Paula Barreleiro, Ginsheim (DE); Roman Morschhäuser, Mainz (DE); Bo Kuhse, Mainz-Kastel (DE); Rolf Ludwig, Eppstein (DE)

(73) Assignee: WEYLCHEM WIESBADEN GMBH, Weisbaden (DE)

( * ) Notice: Subject to any disclaimer, the term of this patent is extended or adjusted under 35 U.S.C. 154(b) by 177 days.

(21) Appl. No.: 16/614,110

(22) PCT Filed: Apr. 5, 2018

(86) PCT No.: PCT/EP2018/000162
§ 371 (c)(1),
(2) Date: Nov. 15, 2019

(87) PCT Pub. No.: WO2018/210442
PCT Pub. Date: Nov. 22, 2018

(65) Prior Publication Data

US 2020/0172838 A1 Jun. 4, 2020

(30) Foreign Application Priority Data

May 17, 2017 (DE) ..... 10 2017 004 742.1

(51) Int. Cl.

| | |
|---|---|
| ***C11D 3/395*** | (2006.01) |
| ***C11D 3/43*** | (2006.01) |
| ***C11D 17/08*** | (2006.01) |
| ***C11D 7/54*** | (2006.01) |
| ***C11D 3/39*** | (2006.01) |
| ***C11D 3/37*** | (2006.01) |
| ***C11D 11/00*** | (2006.01) |
| ***C11D 17/00*** | (2006.01) |
| ***C11D 7/26*** | (2006.01) |
| ***C11D 7/32*** | (2006.01) |
| ***C11D 17/06*** | (2006.01) |

(52) U.S. Cl.
CPC ..... *C11D 3/3935* (2013.01); *C11D 3/3753* (2013.01); *C11D 3/391* (2013.01); *C11D 3/392* (2013.01); *C11D 3/3905* (2013.01); *C11D 3/3917* (2013.01); *C11D 3/3932* (2013.01); *C11D 7/26* (2013.01); *C11D 7/3209* (2013.01); *C11D 11/0023* (2013.01); *C11D 17/0039* (2013.01); *C11D 17/06* (2013.01)

(58) Field of Classification Search
CPC ... C11D 3/3915; C11D 3/3917; C11D 3/3905; C11D 7/26; C11D 7/3209; C11D 17/0039; C11D 17/06
USPC ..... 510/220, 224, 376, 441, 499, 500, 501
See application file for complete search history.

(56) References Cited

U.S. PATENT DOCUMENTS

| | | | | |
|---|---|---|---|---|
| 6,214,785 | B1 | 4/2001 | Himmrich et al. | |
| 7,094,745 | B2 | 8/2006 | Jonas et al. | |
| 7,205,267 | B2 | 4/2007 | Reinhardt et al. | |
| 8,883,704 | B2 | 11/2014 | Borchers et al. | |
| 9,902,921 | B2 | 2/2018 | Reinhardt et al. | |
| 9,902,922 | B2 | 2/2018 | Reinhardt et al. | |
| 2004/0198626 | A1 | 10/2004 | Reinhardt et al. | |
| 2007/0072787 | A1 | 3/2007 | Hazenkamp et al. | |
| 2009/0256113 | A1 | 10/2009 | Borchers et al. | |
| 2010/0041545 | A1* | 2/2010 | Busch | C11D 3/3932 502/165 |
| 2011/0146723 | A1* | 6/2011 | Reinhardt | C11D 3/3932 134/25.2 |
| 2011/0245136 | A1 | 10/2011 | Smets et al. | |
| 2012/0094889 | A1 | 4/2012 | Borchers et al. | |
| 2016/0102276 | A1* | 4/2016 | Hage | C11D 3/3955 502/160 |

FOREIGN PATENT DOCUMENTS

| | | | |
|---|---|---|---|
| CN | 102811699 | A | 12/2012 |
| DE | 2263939 | A1 | 7/1974 |
| DE | 19916187 | A1 | 10/2000 |
| DE | 102009017724 | A1 | 10/2010 |
| EP | 0458397 | A2 | 11/1991 |
| EP | 0458398 | A2 | 11/1991 |
| EP | 0549272 | A1 | 6/1993 |
| EP | 0985728 | A1 | 3/2000 |
| EP | 1445305 | A1 | 8/2004 |
| EP | 1520910 | A1 | 4/2005 |
| EP | 1557457 | A1 | 7/2005 |
| EP | 2966161 | A1 | 1/2016 |
| GB | 1423536 | A | 2/1976 |
| WO | 1996006154 | A1 | 2/1996 |
| WO | 1996006157 | A1 | 2/1996 |
| WO | 2006125517 | A1 | 11/2006 |
| WO | 2007012451 | A1 | 2/2007 |

(Continued)

OTHER PUBLICATIONS

Chinese Office Action dated Sep. 9, 2020 in corresponding Chinese patent application.

(Continued)

*Primary Examiner* — Gregory R Delcotto
(74) *Attorney, Agent, or Firm* — Michael Ferrell

(57) ABSTRACT

The present invention provides granules containing one or more bleaching catalysts selected from the group of manganese salts or manganese complexes and at least one binder selected from the group of acid organic compounds coated with 0.1 to 3% by weight, referring to the total amount of the granules, with a polyvinyl alcohol-containing coating, wherein the coating comprises at least 80% of polyvinyl alcohol or mixtures thereof, in relation to the total weight of the coating.

17 Claims, No Drawings

(56) References Cited

FOREIGN PATENT DOCUMENTS

| | | | |
|---|---|---|---|
| WO | 2010115581 | A1 | 10/2010 |
| WO | 2010115582 | A1 | 10/2010 |
| WO | 2011127030 | A1 | 10/2011 |
| WO | 2014198368 | A1 | 12/2014 |
| WO | 2014198369 | A1 | 12/2014 |

OTHER PUBLICATIONS

International Preliminary Report on Patentability dated Sep. 13, 2019 (in German) and English translation thereof dated Nov. 21, 2019.

* cited by examiner

COATED GRANULES, USE THEREOF, AND WASHING AND CLEANING AGENTS CONTAINING SAME

CLAIM FOR PRIORITY

This application is a national phase application of PCT/EP2018/000162 FILED Apr. 5, 2018, which was based on application DE 10 2017 004 742.1 FILED 17 May, 2017. The priorities of PCT/EP2018/000162 and DE 10 2017 004 742.1 are hereby claimed and their disclosures incorporated herein by reference.

TECHNICAL FIELD

The present invention concerns granules and their use in detergents and in cleaning agents, in particular in dishwashing agents.

BACKGROUND

To obtain spotless dishes, in dishwashing agents persalts, such as perborates and percarbonates, are used for cleaning. To activate these bleaching agents and to achieve a satisfactory bleaching effect when cleaning at temperatures of 60° C. and below, the dishwashing agents usually contain in addition bleaching activators and/or bleaching catalysts.

Bleaching catalysts and/or bleaching activators are used in dishwashing agents preferably in the form of prefabricated granulates to increase their storage stability. In addition to the active ingredients, these granulates usually contain binders. Bleaching granulates are, for example, described in EP 0 985 728 A1, WO 2007/012451 A1, WO 2010/115581 A1, WO 2010/115582 A1, WO 2014/198368 A1, and WO 2014/198369 A1.

It is also known to coat these granules to increase their storage stability. The amount of coating is usually between 1 and 30% by weight, typically between 5 and 30% by weight. Fatty acids, alcohol ethoxylates and film-forming polymers, including polyvinyl alcohol, are proposed as material for the formation of coatings.

DE 2263939 describes bleaching activators containing tablets which are coated with up to 5% by weight of film-forming water-soluble polymers, contain up to 15% by weight of a water-soluble or swellable starch or carboxymethyl starch and up to 1.5% by weight of Mg or Ca salts of saturated $C_{16}$-$C_{20}$ fatty acids. Bleaching catalysts are not included in these tablets.

DE 199 16 187 A1 describes granular bleaching activators from the class of N-acyl and O-acyl compounds containing bleaching aids. These contain at least one granulation aid from the polyvinyl alcohol class. Bleaching catalysts are not included in these granules.

DE 10 2009 017 724 A1 describes bleaching agent co-granulates, which contain besides bleach activators and metal-containing bleaching catalysts in addition at least 3% by weight of one or more organic acids. These co-granulates can optionally be overcoated. As coating materials different substances are used, which are also used as binders. In addition to various film-forming polymers, including polyvinyl alcohol, fatty acids are also mentioned.

SUMMARY OF INVENTION

When using larger amounts of polyvinyl alcohol as a coating material, it has been shown that the granules can glue together during production and storage. An attempt has therefore been made to reduce the amount of coating material. It turned out that, in addition to reducing the tendency to bonding of the granule particles, a surprisingly increased bleaching activity can by achieved, especially against tea stains, when the granules contain bleaching catalysts.

It has also been shown that granules containing bleaching catalysts, coated with small amounts of polyvinyl alcohol, have significantly improved storage stability compared to uncoated granules. This effect also occurs in granules containing besides bleaching catalysts also bleaching activators, but not in granules that are devoid of bleaching catalysts.

The objective of the present invention was therefore the provision of bleaching agent activating granules, which are distinguished against granules known from the prior art by increased storage stability and by increased bleaching agent activation.

The present invention is directed, in part, to granules containing one or more bleaching catalysts selected from the group of manganese salts or manganese complexes and at least one binder selected from the group of acid organic compounds, which are coated with 0.1 to 3% by weight, relating to the total amount of granules, with a polyvinyl alcohol-containing coating, wherein the coating comprises at least 80% of polyvinyl alcohol or mixtures thereof, in relation to the total weight of the coating.

The performance of bleaching agents in detergents and cleaning agents can be significantly increased if the per-compound is brought into contact with a combination of bleaching catalyst and bleaching activator. Here, the bleaching effect of the catalyst is effectively supported by the peroxycarboxylic acid formed from the activator. At the same time, the peroxycarboxylic acid contributes significantly to the germ killing on the material to be cleaned, improves the smell of the washing liquor and prevents the formation of a biofilm in the washing machine or dishwasher. The combination of bleaching catalysts and bleaching activators is therefore useful for increasing the bleaching effect and ensuring hygiene when using bleaching agents in detergents and cleaning agents.

However, the use of bleaching activators and bleaching catalysts as separate particles or granulates also includes disadvantages that can have a negative effect on the bleaching effect. The reactions of the per-compound or of the hydrogen peroxide released from it with the bleaching activator and the bleaching catalyst take place in parallel. If the bleaching catalyst granules dissolve faster than the bleaching activator granules, then the per-compound is already consumed before it can react with the bleaching activator. The same is true in the reverse case.

Granulates containing bleaching activators and bleaching catalysts continue to be beneficial in ensuring the homogeneous distribution of both components in the detergent and cleaning agent and to save space in the formulation. Furthermore, the production costs are reduced, since only one granulate has to be produced instead of two different granulates.

Preferred granules of the invention therefore contain bleaching activators and bleaching catalysts selected from the group of manganese salts or manganese complexes.

In addition to the bleaching activators and/or bleaching catalysts, the granules according to the invention preferably contain at least one binder.

The amount of bleaching activator(s) in the granules according to the invention is usually between 1 and 90% by weight, referring to the total amount of granules. Preferred amounts of bleaching activator(s) range from 50 to 85% by weight.

The amount of bleaching catalyst(s) in the granules according to the invention is usually between 0.01 and 30% by weight, referring to the total amount of granules. Preferred amounts of bleaching catalyst(s) range from 0.1 to 20% by weight.

The amount of binders(s) in the granules according to the invention is usually between 1 and 30% by weight, referring to the total amount of granules. Preferred amounts of binders(s) range from 1 to 20% by weight.

The amount of other additives in the granules according to the invention is usually between 0 and 25% by weight, preferably from 0.1 to 25% by weight, based on the total amount of granules. Particularly preferred quantities range from 2 to 20% by weight.

As particularly advantageous in terms of their performance and storage stability and therefore preferred are granules of the invention containing, based on the total weight of the granules, a) 1 to 90% by weight of one or more bleaching activators
b) 0.01 to 30% by weight of one or more bleaching catalysts selected from the group of manganese salts or manganese complexes, and
c) 1 to 30% of one or more binders.

Particularly preferred, the granules according to the invention contain, based on the total weight of the granules, a) 50 to 85% by weight of one or more bleaching activators
b) 0.1 to 20% by weight of one or more bleaching catalysts selected from the group of manganese salts or manganese complexes, and
c) 1 to 20% by weight of one or more binders.

As particularly advantageous in terms of performance and storage stability and therefore preferred are granules of the invention containing, referring to the total weight of the granules, 1 to 3% of a coating from polyvinyl alcohol.

In of a particularly preferred embodiment of the invention the granules according to the invention contain, referring to the total weight of the granules, a) 50 to 85% by weight of one or more bleaching activators,
b) 0.1 to 20% of one or more bleaching catalysts selected from the group of manganese salts or manganese complexes,
c) 5 to 20% by weight of low molecular and/or polymeric organic acid,
d) 0 to 20% by weight of a binder that is not an organic acid according to component c), and
e) 1 to 3% by weight of a coating made of polyvinyl alcohol.

DETAILED DESCRIPTION

As bleaching activators, the granules of the invention can contain compounds generally known from the prior art. These are preferably multiple acylated alkylene diamines, in particular tetraacetylethylene diamine (TAED), acylated triazine derivatives, in particular 1.5-diacetyl-2,4-dioxohexahydro-1,3,5-triazine (DADHT), acylated glycolurils, in particular tetraacetylglycoluril (TAGU), N-acylimides, in particular N-nonanoyl succinimide (NOSI), acylated phenolic sulfonates, in particular n-nonanoyloxi- or n-lauroyloxibenzenesulfonate (NOBS or LOBS), acylated phenolic carboxylic acids, in particular nonanoyloxi- or decanoyloxibenzoic acid (NOBA or DOBA, respectively), carboxylic acid anhydrides, in particular phthalic acid anhydride, acylated multivalent alcohols, preferably triacetine, ethyleneglycol diacetate and 2.5-diacetoxy-2.5-dihydrofurane as well as acetyliertated sorbitol and mannitol or their mixtures, respectively (SORMAN), acylated sugar derivatives, preferably pentaacetylglucose (PAG), pentaacetylfructose, tetraacetylxylose and octaacetyllactose as well as acetylated and optionally N-alkylated glucamine and gluconolactone, and/or N-acylated lactams, for example N-benzoylcaprolactam. Hydrophilic substituted acylacetales and acyllactames can also preferably be used. In addition, nitrile derivatives such as n-methyl-morpholinium acetonitrilmethyl sulfate (MMA) or cyanomorpholine (MOR) can be used as bleaching activators. Combinations of bleaching activators can also be used.

Particularly preferred bleaching activators are TAED and DOBA.

As bleaching catalysts the granules of the invention contain the bleaching enhancing transition metal salts or complexes of manganese generally known from the prior art.

When using metal salts, in particular manganese salts in oxidation levels +2 or +3 are preferred, for example manganese halogenides, where the chlorides are preferred, or the manganese salts of organic acids, such as manganese acetates, manganese acetylacetonates, manganese oxalates or manganese nitrates.

Furthermore, preferably used bleaching catalysts are complexes of manganese in the oxidation levels II, III, IV or IV, which preferably have one or more macrocyclic ligand(s) with the donor functions N, NR, PR, O and/or S included. Preferably, bleaching catalysts are used with ligands that exhibit nitrogen donor functions.

Transition metal complexes preferably used as bleaching catalysts in the granules of the invention are complexes containing as macromolecular ligands 1.4.7-trimethyl-1.4.7-triazacyclononane (Me-TACN), 1.4.7-triazacyclononane (TACN), 1.5.9-trimethyl-1.5.9-triazacyclododecane (Me-TACD), 2-methyl-1.4.7-trimethyl-1.4.7-triazacyclononane (MeMeTACN) and/or 2-methyl-1.4.7-triazacyclononane (Me/TACN) or bridged ligands, such as 1.2-bis-(4.7-dimethyl-1.4.7-triazacyclonono-1-yl) ethane (Me4-DTNE) or derivatives of cyclams or cyclens, such as 1.8-dimethylcyclam, 1.7-dimethylcyclen, 1.8-diethylcyclam, 1.7-diethylcyclen, 1.8-dibenzylcyclam and 1.7-dibenzylcyclen. Examples can be found in EP 0 458 397, EP 0 458 398, EP 0 549 272, WO 96/06154, WO 96/06157 or WO 2006/125517. Manganese complexes can be preferably used as bleaching catalysts in the granules according to the invention, as they are known from EP 1 445 305, EP 1 520 910 or EP 1 557 457.

Mono- or dinuclear complexes of manganese containing at least one ligand of general formulae A or B are particularly preferred as bleaching catalysts in the granules according to the invention Formula A

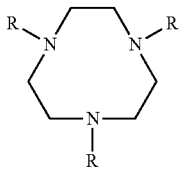

-continued

Formula B

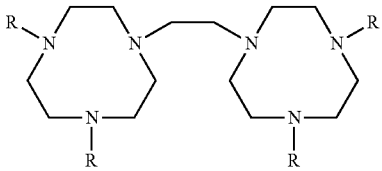

with R=H, $CH_3$, $C_2H_5$ or $C_3H_7$.

Preferred ligands are 1.4.7-trimethyl-1.4.7-triazacyclononane (Me3-TACN), 1.4.7-triazacyclononane (TACN) or bridged ligands such as 1.2-bis-(4.7-dimethyl-1.4.7-triazacyclono-1-yl)ethane (Me4-DTNE), such as those described in EP 0 458 397, EP 0 458 398, EP 0 549 272, WO 96/06154, WO 96/06157 or WO 2006/125517.

Particularly preferred bleaching catalysts are, for example, the multi-nuclear complexes $[Mn^{III}_2(\mu\text{-}O)_1(\mu\text{-}OAc)_2(TACN)_2](PF_6)_2$, $[Mn^{IV}_2(\mu\text{-}O)_3(Me_3\text{-}TACN)_2](PF_6)_2$, $[Mn^{IV}_2(\mu\text{-}O)_3(Me_3\text{-}TACN)_2](SO_4)$, $[Mn^{IV}_2(\mu\text{-}O)_3(Me_3\text{-}TACN)_2](OAc)_2$, $[Mn^{IV}_2(\mu\text{-}O)_3(Me_3\text{-}TACN)_2](Cl)_2$, $[Mn^{IV}Mn^{III}_2(\mu\text{-}O)_2(OAc)(Me_4\text{-}DTE)](Cl)_2$, $[Mn^{IV}Mn^{III}_2(\mu\text{-}O)_2(OAc)(Me_4\text{-}DTE)](PF_6)_2$ or the mononuclear complexes $[Mn^{IV}(Me_3\text{-}TACN)(OCH_3)_3]PF_6$, (prepared according to EP 544 519), $[Mn^{IV}(Me_3\text{-}TACN)(OC_2H_5)_3]PF_6$ and $[Mn^{IV}(Me_3\text{-}TACN)(acac)OH]PF_6$ or $[Mn^{III}(Me_3\text{-}TACN)(acac)OC_2H_5]PF_6$, the latter produced after K. Wieghardt etal., Zeitschrift für Naturforschung 43b, 1184-1194 (1988). Since some of these complexes crystallize in hydrated form (with crystal water), these forms are used preferentially, an example of which is .$[Mn^{IV}_2(\mu\text{-}O)_3(Me_3\text{-}TACN)_2](PF_6)_2*H_2O$.

Particularly preferred manganese complexes are, for example, $Mn^{III}_2(\mu\text{-}O)_1(\mu\text{-}OAc)_2(TACN)_2](PF_6)_2$, $[Mn^{IV}_2(\mu\text{-}O)_3(Me\text{-}TACN)_2](PF_6)_2$, $[Mn^{IV}_2(\mu\text{-}O)_3(Me\text{-}TACN)_2](SO_4)$, $[Mn^{IV}_2(\mu\text{-}O)_3(Me\text{-}TACN)_2](OAc)_2$, $[Mn^{IV}_2(\mu\text{-}O)_3(Me\text{-}TACN)_2](Cl)_2$, $[Mn^{IV}_2(\mu\text{-}O)_3(Me4\text{-}DTE)](PF_6)_2$, $[Mn^{IV}_2(\mu\text{-}O)_3(Me4DTE)](Cl)_2$, $[Mn^{IV}_2(\mu\text{-}O)_3(Me4\text{-}DTE)](SO_4)$, $[Mn^{IV}_2(\mu\text{-}O)_3(Me4\text{-}DTE)](OAc)_2$, 1.8-diethyl-1.4.8.11-tetraazacyclotetradecane-manganese-(II)-chloride or 1.4.8.11-tetraazacyclotetradecane-manganese-(II)-chloride.

As a further ingredient the granules according to the invention contain a binder to improve the cohesion of the granules.

As binders, preferably substances selected from fatty acids, alcohol ethoxylates and organic polymers can be used. Mixtures of different binders or different binders of the same type can also be used.

As organic polymers in the context of the present description synthetic and natural polymers are understood as well as modified polymers of natural origin.

The binders can be neutral or acidic organic polymers or even low-molecular organic compounds. Preferably used are acidic organic compounds thus acidic low-molecular organic compounds or acidic polymeric organic compounds. These can be used either in the form of free acid or in partially neutralized form. In the context of the present invention, therefore, the term "organic acid " encompasses both organic acids in free form and in partially neutralised form.

As counterions alkaline metal ions, especially Na ions, are preferred.

Suitable binders include, among others, organic fatty acids with 8 to 22 carbon atoms, such as lauric acid, myristic acid, stearic acid or mixtures thereof. Organic polymers are also preferred. The organic polymers can be of anionic, cationic or amphoteric nature. Natural organic polymers and modified organic polymers of natural origin can be used, as well as synthetic organic polymers.

The group of organic polymers very preferably used as a binder includes polyvinyl alcohols including their acetalized derivatives, polyvinyl pyrrolidones and polyalkylene glycols, especially polyethylene glycols.

Polyvinyl alcohols, which can preferably be used as binders, are described in greater detail below when describing the polyvinyl alcohols making up the sheath.

The anionic polymers used with particular preference as binders are in particular homo- or copolymeric polycarboxylates. Preferably, polyacrylic acids or polymethacrylic acids, especially those with a relative molecule mass of 500 to 70,000 g/mol are used.

Among these preferred are polyacrylates which preferably have a molecular mass of 2,000 to 20,000 g/mol. Due to their solubility, the short-chain polyacryates having molar masses from 2,000 to 10,000 g/mol and preferably from 3,000 to 5,000 g/mol are preferred from this group.

Among these further preferred are the copolymeric polycarboxylates, especially those of acrylic acid with methacrylic acid and acrylic acid or methacrylic acid with maleic acid. Copolymers of acrylic acid with malic acid, which contain 50 to 90% by weight of acrylic acid and 50 to 10% by weight of malic acid, are particularly suitable. Their relative molecular mass in relation to free acids is preferably 2,000 to 70,000 g/mol, particularly preferred 20,000 to 50,000 g/mol and most particularly preferred 30,000 to 40,000 g/mol.

To improve the water solubility, the polymers can also contain structural units formed from allyl sulphonic acids, such as allyloxybenzolsulphonic acid and methallyl sulphonic acid. Also preferably preferred are biodegradable polymers from more than two different monomer units, such as those containing structural units from salts of acrylic acid and maleic acid, as well as of vinyl alcohol and vinyl alcohol derivatives and sugar derivatives or the structural units from salts of acrylic acid and 2-alkylallyl sulphonic acid and from sugar derivatives.

Other preferred copolymers are those having structural units resulting from acrolein and acrylic acid/acrylic acid salts and acrolein and vinyl acetate, respectively.

Other anionic polymers preferably used as binders are sulphonic acid-group-containing polymers, in particular copolymers from unsaturated carboxylic acids, sulphonic acid group containing monomers and optionally other ionogenic or non-ionogenic monomers.

Other preferred binders are $C_8$-$C_{22}$ alcohol ethoxylate solid at room temperature, preferably $C_8$-$C_{22}$ alcohol ethoxylates with an average of 10 to 100 ethylene oxide units in the molecule, such as Genapol® T 500 from Clariant or carboxymethyl celluloses.

The low-molecular organic acids, which are also preferred as binders, can be used either in the form of free acid or in partially neutralized form. Preferably used low-molecular organic acids are citric acid, ascorbic acid, oxalic acid, adipic acid, succinic acid, glutaric acid, malic acid, tartaric acid, maleic acid, fumaric acid, sugar acids, aminocarboxylic acids, fatty acids as well as mixtures from these.

Particularly preferred low-molecular organic acids are oxalic acid, ascorbic acid, citric acid and fatty acids.

The granules according to the invention comprise a small amount of polyvinyl alcohol coating, which ensures storage stability even in tableted formulations. According to the invention, the proportion of the protective or coating layer in the total granulate is 0.1 to 3% by weight, and in particular 1 to 3% by weight.

Typical polyvinyl alcohols used for formation of a coating or as a binding agent according to the invention have an average numerical weight of molecular weight in the range between 10,000 and 200,000 (as measured at 20° C. using the method of gel permeation chromatography (GPC)) (corresponding to a viscosity of a 4% aqueous solution at 20° C. of about 2 to 70 mPa*s; measured by falling ball ball viscosimeter according to Höppler, DIN 53015).

Polyvinyl alcohol is generally produced by saponification of polyvinyl acetate.

Particularly suitable polyvinyl alcohol has a hydrolysis degree of 70 to 100 mol % and its aqueous solution has a viscosity according to Höppler at 20° C. of 2 to 70 mPa*s.

Other suitable polyvinyl alcohols may have been modified in some manner hydrophobically or hydrophilically.

Examples of hydrophobically modified polyvinyl alcohols containing non-water-soluble monomer blocks in their main chain include ethylene-containing polyvinyl alcohols of type Exceval® from Kuraray.

Another option is to modify by grafting reactions at the alcohol groups, such as by partial acetalisation of the alcohol groups of the polyvinyl alcohol, whereby the polyvinyl alcohols can be equipped with any residues that may be either hydrophobic or hydrophilic, such as Mowiflex® type polyvinyl alcohols from Kuraray.

The modifying residues can be block-like or statistically arranged.

Preferably used polyvinyl alcohols and acetalised polyvinyl alcohols have molecular weights in the range of 10,000 to 200,000 g/mol, preferably from 11,000 to 90,000 g/mol, especially preferred from 12,000 to 80,000 g/mol and especially preferred from 13,000 to 70,000 g/mol. Preferably used polyethylene glycols have molar masses ranging from 200 to 5.000.000 g/mol, corresponding to polymerisation degrees of 5 to >100,000.

In the production of the coating, mixtures of different polyvinyl alcohols or mixtures of polyvinyl alcohols with other organic polymers or low-molecular compounds can be used. The vast majority of the coating consists of polyvinyl alcohol or mixtures thereof, thus to at least 80% of polyvinyl alcohol or mixtures thereof, in relation to the total weight of the coating.

Optionally dyes can also be added to the granules according to the invention. Dyes can be in the granulate core and/or in the coating. Preferably, dyes are added to the granules before it has been coated with a sheath.

In another preferred embodiment, the invention concerns granules containing other additives in addition to the components described above.

In this embodiment, the granules according to the invention can therefore have bleaching catalysts and/or bleaching activators, possibly binders and other additives.

For example, sikkatives, such as calcium sulfate, may be used as other additives.

The production of the granules according to the invention can be carried out according to methods known per se and has already been described in detail in the above-mentioned patent documents. There are basically different granulation methods available.

In a first preferred process variant, building-up of the granules takes place in mixing apparatus. The components are processed in usual mixing devices operating batch-by-batch or continuously, which are usually equipped with rotating mixing organs. When mixing, all mixing variants are conceivable, which ensure a sufficient mixing of the components.

In a preferred embodiment, all components are mixed at the same time. However, multi-stage mixing processes are also conceivable, in which the individual components are entered in the overall mixture individually or together with other additives in different combinations.

The order of slow and fast mixers can be exchanged according to requirements. The dwell times in the mixer granulation are preferably 0.5 s to 20 min, especially preferred 2 s to 10 min. The granulation fluid can be pumped into the mixing apparatus via simple conduction tubes. For better distribution, however, nozzle systems (single- or multi-material nozzles) are also conceivable.

In dependence of the granulation fluid used (solvent or molten binder) a drying step (for solvents) or a cooling step (for melts) follows the granulation stage to avoid conglutination of the granules. Then, by sieving the coarse grain parts and the fine grain parts are separated. The coarse grain content is crushed by grinding and, like the fine grain content, is fed to a new granulation process. The application of the coating is preferably provided in a fluidized bed apparatus, for example in a fluidized bed mixer.

In another preferred process variant, the powdered components (bleaching activator and/or bleaching catalyst and optionally other additives) are combined with one or more plasticization agents. These can be entered as a liquid or as a melt, preferring molten substances.

The liquid plasticizers are intensively mixed with the powdery active substance and the other additives optionally present, resulting in a plastically deformable mass. The mixing step can be performed in the above-mentioned mixing apparatus, but also kneaders or special extruder types are conceivable. The granulation mass is then pressed by means of tools through the nozzle holes of a press matrix, creating cylindrically shaped extrudates. The exiting extrudates must be crushed to the desired length or particle size by a post-processing step. In many cases, a length/diameter ratio of L/D=1 is desired. For cylindrical granules, the particle diameter is typically between 0.2 and 2 mm, preferably between 0.5 and 0.8 mm, the particle length is in the range of 0.5 to 3.5 mm, ideally between 0.9 and 2.5 mm. The length or size adjustment of the granules can be obtained, for example, by fixed stripper knives, rotating cut knives, cut wires or blades. To round off the cutting edges, the granules can then be rounded again in a rondier.

After the size adjustment of the granules, a final solidification step is required in which the solvent is removed or the melt is solidified and the coating is then applied. This step is usually carried out in a fluidized bed apparatus, which is operated as a dryer or cooler, depending on the requirements. Then, by sieving the coarse grain part and the fine grain part is separated. The coarse grain content is crushed by grinding and, like the fine grain content, is fed to a new granulation process. After that, the generated granules are equipped with a coating in a fluidized bed apparatus, for example in a fluidized bed mixer.

In another preferred process variant, the powdered active substances may be mixed with other preferably solid additives optionally present and this mixture is compacted, then ground and then optionally sieved into individual grain fractions. Optionally to the mixture may also be added a certain extent (e.g. up to 10% by weight) of liquid additives. Examples of compacting aids include water glass, polyethylene glycols, non-ionic surfactants, polycarboxylate copolymers, modified and/or unmodified cellulose, bentonite, hectorites, saponite and/or other detergent ingredients.

The compactation is preferably carried out on so-called roll compactors (e.g. from Hosokawa-Bepex, Köppern). By choosing the roll profile, piecemeal pellets or briquettes can be created on the one hand and press scabs on the other. While the piecemeal compacts are usually only separated from the fine content, the scabs in a mill have to be crushed to the desired particle size. Typically, as mill type preferably gentle types are used. Subsequently, the crushed particles are covered with a coating in a fluidized bed apparatus, for example in a fluidized bed mixer.

The granules produced in this way are separated by sieving the fine grain content and optionally from the coarse grain content. The coarse grain content is once again fed to the mill, and the fine grain part is once again fed to the compactation. Established sieving machines such as tumber sieving or vibration sieves can be used to classify the granules.

Primary characteristic for the granules according to the invention is their chemical composition. Nevertheless, it has been shown that the action of these granules can also have a beneficial effect through the influence of physical parameters, such as particle size, the fine percentage as well as the content of bleaching catalyst and/or bleach activator.

Preferred granules according to the invention for this reason have a mean particle size of between 0.1 and 1.6 mm, preferably between 0.2 and 1.2 mm and especially preferred between 0.3 and 1.0 mm, each measured by sieve analysis.

In particularly preferred granules according to the invention, the volume-average size of the primary particles ranges from 1 μm to 150 μm, and the finished granules have an average particle size of between 0.1 and 1.6 mm.

Preferred granules according to the invention are also characterized by a water content of less than 5% by weight (measured by Karl Fischer), based on the total amount of granules.

Particularly preferred granules according to the invention have a water content of less than 3% by weight, especially preferred 0 to 2% by weight, based on the total amount of granules.

The granules according to the invention are suitable for use in all detergents or cleaning agents, whereby their use in agents for cleaning dishes, especially for the machine cleaning of dishes, has proved to be particularly beneficial.

Another subject-matter of the present invention is therefore the use of the granules according to the invention for the production of detergents and cleaning agents and, preferably of agents for cleaning dishes.

Another subject-matter of the present invention are also detergents and cleaning agents, preferably agents for cleaning dishes, containing granules according to the invention.

Preferred detergent and detergents and cleaning agents according to the invention, in particular the agents for cleaning dishes, contain the granules according to the invention in quantities between 0.1 and 10% by weight, preferably in quantities between 0.2 and 8% by weight and especially preferred in quantities between 0.5 and 6% by weight.

The detergents and cleaning agents according to the invention, in particular the agents for cleaning dishes, which can be present as granules, powder- or tablet-shaped solids, but also in liquid or pasty form, may, in addition to the granules according to the invention in principle can contain all known and common ingredients. The detergents and cleaning agents according to the invention, in particular the agents for cleaning dishes, can contain in particular builders, peroxygen compounds, enzymes, alkaline carriers, surface-active agents, pH regulators, organic solvents and other auxiliary substances, such as glass corrosion inhibitors, silver corrosion inhibitors and foam regulators. The co-granules according to the invention are suitable for use in phosphate-containing and in phosphate-free formulations.

Particularly preferred detergents and cleaning agents, especially agents for cleaning dishes, contain (i) 15 to 65% by weight, preferably 20 to 60% by weight of a water-soluble builder component,
(ii) 5 to 20% by weight of a peroxygen-based compound,
(iii) 0.5 to 6% by weight of a granule according to the invention, and
(iv) 0 to 50% by weight of other additives, such as enzymes, alkaline carriers, surface-active agents, pH regulators, organic solvents or other additives, such as glass corrosion inhibitors, silver corrosion inhibitors and foam regulators, each referring to the total weight of detergent and cleaning agent.

Such an agent is particularly of low alkalinity, i.e. its 1 weight-percentage solution has a pH in the range of 8 to 11.5 and preferably from 9 to 11.

As water-soluble builder components in the detergents and cleaning agents according to the invention, in particular the agents for cleaning dishes, all builders normally used in such agents are eligible in principle. Examples include alkaline phosphates, which may be present in the form of their alkaline, neutral or acidic sodium or potassium salts, in particular trinatrium phosphate, tetrateratrium diphosphate, dinatrium dihydrogen-diphosphate, pentanatrium triphosphate, so-called sodium hexametaphosphate as well as the corresponding potassium salts or mixtures of sodium and potassium salts. Their quantities can range from 15 to about 65% by weight, preferably from 20 to 60% by weight, in relation to the total agent. In addition to polyphosphonates and phosphonate-alkyl carboxylates, other possible water-soluble builder components include organic polymers of native or synthetic origin of the type of polycarboxylate, which are used as co-builders, especially in hard water regions. Possible are, for example, polyacrylic acids and copolymers from maleic acid anhydride and acrylic acid, as well as the sodium salts of these polymer acids. Commercial products include Sokalan® CP 5, CP 10 and PA 30 from BASF. Polymers of native origin that can be used as co-builders include, for example, oxidized starch and polyamino acids such as polyglutamic acid or polyasparaginic acid. Other possible water-soluble builder components include naturally occurring hydroxy carboxylic acids, such as mono-, dihydroxy succinic acid, alpha hydroxypropionic acid and gluconic acid. Preferred organic water-soluble builder components include the salts of citric acid, especially sodium citrate. Water free trinatrium citrate and preferably trinatrium citrate dihydrate are considered as sodium citrate. Trinatrium citrate dihydrate can be used as a fine or coarse crystalline powder. Depending on the pH value ultimately set in the detergents and cleaning agents according to the invention, in particular the agents for cleaning dishes, the acids corresponding to the aforementioned co-builder salts may also be present. Particularly preferred builder components in phosphate-free formulations are methylglycindiacetate (MDGA, for example Trilon® M, BASF), L-glutamine acid, N, N-(biscarboxymethyl)-tetra sodium salt (GLDA, Dissolvine® DL, Akzo Nobel), sodium polyaspartate (Baypure®, Lanxess) or salts of the iminodisuccinic acid (Baypure®, Lanxess).

Peroxygen compounds preferentially used in the detergents and cleaning agents according to the invention, in particular in the agents used for cleaning dishes, are perborates and percarbonates, in particular the corresponding sodium salts of these compounds.

The enzymes optionally contained in detergents and cleaining agents according to the invention, in particular in the agents for cleaning dishes, are proteases, amylasens, pullulanases, cutinases and/or lipases, for example proteases, such as BLAP™, Optimase™, Opticlean™, Maxacal™, Maxapem™, Durazym™, Purafect™ OxP, Esperase™ and/or Savinase™, amylases, such as Termamyl™, Amylase-LT™, Maxamyl™, Duramyl™ and/or lipases, such as Lipolase™, Lipomax™, Lumafast™ and/or Lipozym™. The enzymes used can be adsorbed to carrier substances and/or embedded in enveloping substances to protect them against premature inactivation. They are used in the detergents and cleaning agents according to the invention, in particular in the agents for cleaning dishes, preferably in quantities of up to 10% by weight and especially preferred in quantities of 0.05 to 5% by weight, wherein preferably enzymes stabilized against oxidative degradation are used.

Preferably, the detergents and cleaning agents according to the invention, in particular the agents for cleaning dishes, contain the usual alkaline carriers, such as alkali silicates, alkali carbonates and/or alkali hydrogencarbonates. The alkaline carriers commonly used include carbonates, hydrogen carbonates and alkali silikates with a mol ratio $SiO_2/M_2O$ (M=alkali atom) from 1:1 to 2.5:1. Alkali silikates can be used in quantities of up to 40% by weight, especially from 3 to 30% by weight, based on the total weight of the detergent and cleaning agent. The alkaline carrier system preferably used in the detergents and cleaning agents according to the invention, especially in the agents for cleaning dishes, is a mixture of carbonate and hydrogen carbonate, preferably sodium carbonate and -hydrogen carbonate, which me be present in a quantity of up to 50% by weight and preferably from 5 to 40% by weight.

In another preferred embodiment of the invention the detergents and cleaining agents according to the invention, in particular the agents for cleaning dishes, contain 20 to 60% by weight of water-soluble organic builders, especially alkali citrate, 3 to 20% by weight of alkali carbonate and 3 to 40% by weight of alkali disilicate.

Surfactants, especially anionic surfactants, zwitterionic surfactants and preferably weakly foaming non-ionic surfactants, may also be added to the detergents and cleaining agents according to the invention. These will serve to better separating fatty contaminants, as wetting agent and optionally as a granulation aid in the context of the production of these agents. Their quantity can be up to 20% by weight, preferably up to 10% by weight and is particularly preferred in the range of 0.5 to 5% by weight, referring to the total weight of the detergent and cleaining agent.

Usually extremely low foaming compounds are used in agents of machine cleaning of dishes. These include, preferably, $C_{12}$-$C_{18}$-alkylpolyethylene glycol pol<propylene glycolether with up to 8 mol ethylene oxide and propylene oxide units in each molecule. Other known low-foaming non-ionic surfactants can also be used, such as $C_{12}$-$C_{18}$ alkylpolyethyleneglycolpolybutyleneglycol ether with up to 8 mol ethylene oxide and butylene oxide units in the molecule, endgroup-chapped alkylpolyalkyleneglycol mixed ethers and the foaming, but ecologically attractive $C_8$-$C_{14}$-alkyl polyglucosides with a polymerisation level of about 1 to 4 and/or $C_{12}$-$C_{14}$ alkylpolyethylene glycols with 3 to 8 ethylene oxide units in the molecule. Also suitable are surfactants from the family of glucamides, such as alkyl-N-methylglucamides, in which the alkyl part preferably is derived from a fatty alcohol with the C chain length of $C_6$-$C_{14}$. It is partially beneficial when the described surfactants are used as mixtures, for example the combination of alkyl polyglycoside with fatty alcoholethoxylates or glucamides with alkyl polyglycosides. The presence of aminoxides, betaines and ethoxylated alkylamines is also possible.

In order to adjust a desired pH, which does not arise from itself by mixture of the other components, the detergents and cleaining agents according to the invention, in particular the agents for cleaning dishes, may contain system- and environmentally-friendly acids, in particular, citric acid, acetic acid, tartaric acid, malic acid, lactic acid, glycolic acid, suberic acid, glutaric acid and/or adipic acid, but also mineral acids, in particular sulfuric acid or alkali hydrogen sulfate, or bases, in particular ammonium or alkali hydroxides. Such pH regulators are included in the detergents and cleaning agents according to the invention, in particular in the agents for cleaning dishes, preferably not exceeding 10% by weight and especially preferred from 0.5 to 6% by weight, in relation to the total weight of the agent.

Organic solvents that can be used in the detergents and cleaining agents according to the invention, in particular in the agents for cleaning dishes, especially if they are available in liquid or pasty form, include alcohols with 1 to 4 C-atoms, preferably methanol, ethanol, isopropanol and tert.-butanol, dioles with 2 to 4 C atoms, in particular ethylene glycol and propylene glycol, as well as their mixtures and ethers that can be derived from the mentioned substance classes. Such water-mixable solvents are present in the detergents and cleaning agents according to the invention, especially in the agents for cleaning dishes, preferably in a quantity not exceeding 20% by weight and especially preferred from 1 to 15% by weight, most preferably from 1 to 15% by weight.

In order to prevent glass corrosion during the flushing process, appropriate inhibitors can be used in the inventive detergents and cleaning agents, in particular in the agents for cleaning dishes. Crystalline layered silicates and/or zinc salts are particularly beneficial here. The crystalline layer-shaped silicates, for example, are marketed by WeylChem Wiesbaden GmbH under the trade name Na-SKS, e.g. Na-SKS-1 ($Na_2Si_{22}O_{45}\cdot xH_2O$, Kenyait), Na-SKS-2 ($Na_2Si_{14}O_{29}\cdot xH_2O$, Magadiit), Na-SKS-3 ($Na_2Si_8O_{17}\cdot xH_2O$) or Na-SKS-4 ($Na_2Si_4O_9\cdot xH_2O$, Makatit). Of these, it is mainly Na-SKS-5 (alpha-$Na_2Si_2O_5$), Na-SKS-7 (beta-$Na_2Si_2O_5$, Natrosilit), Na-SKS-9 ($NaHSi_2O_5\cdot H_2O$), Na-SKS-10 ($NaHSi_2O_5\cdot 3H_2O$, Kanemit), Na-SKS-11 (t-$Na_2Si_2O_5$) and Na-SKS-13 ($NaHSi_2O_5$), but in particular Na-SKS-6 (delta-$Na_2Si_2O_5$). An overview of crystalline layer silicates can be found, for example, in the article published in "Seifen-Öle-Fette-Wachse, volume 116, no. 20/1990 ," on pages 805-808.

In another preferred embodiment, the detergents and cleaning agents according to the invention, in particular the agents for cleaning dishes, contain a quantity of the crystalline layer-silicates of 0.1 to 20% by weight, especially preferred 0.2 to 15% by weight, and in particular preferred 0.4 to 10% by weight, each referring to the total weight of the agent.

To suppress glass corrosion, detergents and cleaning agents according to the invention, in particular agents for cleaning dishes, may contain at least one zinc or bismuht salt, preferably selected from the group of organic zinc salts, especially preferred selected from the group of soluble organic zinc salts, in particular preferred selected from the group of soluble zinc salts of monomer or polymer organic acids and extraordinarily preferred selected from the group zinc acetate, zinc acetylacetonate, zinc benzoate, zinc formiate, zinc actate, zinc gluconate, zinc oxide, zinc ricinoleate, zinc abietate, zinc valerate and zinc p-toluenesulfonate. Alternatively, or in combination with these zinc salts, bismuth salts such as bismuth acetate can be used.

Preferentially used in the context of the present invention are detergents and cleaning agents according to the invention, in particular agents for cleaning dishes, in which the amount of zinc salt in relation to the total weight of the totel weight is 0.1 to 10% by weight, preferably 0.2 to 7% by weight and especially preferred 0.4 to 4% by weight, regardless of which zinc salts are used, especially regardless of whether organic or inorganic zinc salts, soluble or non-soluble zinc salts or their mixtures are used.

In order to cause a silver corrosion protection, silver corrosion inhibitors can be used in the detergents and cleaning agents according to the invention, especially in the agents for cleaning dishes. Preferred silver corrosion inhibitors are organic sulfides, such as cystin and cysteine, two- or three-valent phenols, optionally alkyl or aryl-substituted triazoles such as benzotriazole, isocyanuric acid, titanium, zirconium, hafnium, cobalt or cer salts and/or complexes, in which the mentioned metals are present in one of the oxidation levels II, III, IV, V or VI, depending on the metal.

If the detergents and cleaning agents according to the invention, in particular the agents for cleaning dishes, foam too much during use, for example in the presence of anionic surfactants, they can still have up to 6% by weight, preferably about 0.5 to 4% by weight of a foam-suppressing compound, preferably from the group of silicone oils, mixtures of silicone oil and hydrophobated silica, paraffins, paraffin alcohol combinations, hydrophobic silica, the bis-fatty acid amides, and other known and commercially available defoamers.

The detergents and cleaning agents according to the invention, in particular the agents for cleaning dishes, can contain as other ingredients those means known from the prior art, for example complexing agents, electrolytes, additional per-oxygen activators, dyes or fragrances, such as perfume oils.

The production of the solid detergents and cleaning agents according to the invention, in particular the agents for cleaning dishes, offers no difficulties and can in principle be performed in a known way, for example by spray drying or granulation, whereby peroxygen compound and inventive co-granules may be added separately later.

The detergents and cleaning agents according to the invention in the form of aqueous solutions or of other common solvent-containing solutions, in particular corresponding agents for cleaning dishes, are particularly beneficially prepared by simply mixing the ingredients which can be placed in substance or as a solution in an automatic mixer.

The detergents and cleaning agents according to the invention, in particular the agents for cleaning dishes, are preferably available as powdered, granular or tablet-shaped preparations, which are known pre-se, and may be prepared for example by mixing, granulating, roll compacting and/or by spray drying of thermally resilient components and by adding the more thermally sensitive components, which are in particular enzymes, bleaching agents and bleaching catalysts.

For the production of detergents and cleaning agents according to the invention, in particular the agents for cleaning dishes, in tablet form, preferably all the components are mixed together in a mixer and the mixture is pressed by means of traditional tablet presses, such as eccentric presses or circular presses, using pressing pressures ranging from $200 \cdot 10^5$ Pa to $1500 \cdot 10^5$ Pa.

This makes it easy to obtain break-resistant and yet, under the intended conditions, sufficiently fast soluble tablets with a bending strength of normally more than 150 N. Preferably, a tablet manufactured in such manner weighs 15 to 40 g, especially from 20 to 30 g, with a diameter of 35 to 40 mm.

The production of inventive detergents and cleaning agents in the form of non-dusty, storage-capable powders and/or granules with high bulk densities in the range of 800 to 1,000 g/l, in particular corresponding inventive agents for cleaning dishes can be performed by mixing the builder components with at least a proportion of liquid mixing components in a first part of the process, increasing the bulk density of this pre-mixture and following—if desired after intermediate drying—combining the pre-mixture obtained in this way with the other components of the agent, including the granules according to the invention.

Agents for machine cleaning of dishes according to the invention can be used in household dishwashers as well as in commercial dishwashers. The addition is performed by hand or by means of suitable dosing devices. The application concentrations in the cleaning solution are usually about 1 to 8 g/l, preferably 2 to 5 g/l.

A machine rinse program is usefully supplemented and terminated by some intermediate flushes with clear water and a clear-rinsing duct with a common clear-rinser following the cleaning aisle. After drying, one gets completely clean and hygienically flawless dishes when using the inventive agent.

EXAMPLES

In the following examples % readings mean weight percent, unless explicitly stated otherwise.

Example 1 and Comparative Examples V1 and V2

Example 1

On a fluidized bed spray granulation system of type Glatt AG400, commercially uncoated bleach activator granules were coated by spraying an aqueous solution of polyvinyl alcohol. Bleaching activator granules Peractive® FDO-X (commercial product of WeylChem Wiesbaden GmbH) were used. These included a bleaching catalyst (MnTACN) and a bleaching activator (TAED) as well as the acidic polymer Sokalan® CP 45 (polyacrylate, sodium salt, commercial product of BASF SE). The product Poval® 6-88 (Kuraray commerical product) was used as polyvinyl alcohol. The amount of polyvinyl alcohol was chosen in such a manner that the proportion of sheath in the finished product was 3%.

Comparative Example V1

It was worked as in Example 1 with the modification that the amount of polyvinyl alcohol was chosen in such a manner that the proportion of sheath in the finished product was 6%.

Comparative Example V2

This was the uncoated product Peractive® FDO-X (commerical product of WeylChem Wiesbaden GmbH).

Application Example—Storage Test in Machine Dishwasher Detergent

In order to check the physical stability of the granules according to the invention, the storage behavior in a typical machine dishwasher detergent was examined. The mixtures could then be stored for several weeks in the indoor climate and in aggravated climate conditions (T=40° C., 75% relative humidity).

Application Examples—Bleaching Performance 20 g of the IEC-C dishwasher detergent was combined with corresponding amounts of the non-stored granules 1, V1 or V2, so that in each of the formulation 4 mg bleach catalyst (calculated as 100% active) were present. The formulations were used to flush 6 teacups (soiled according to ICW test protocol) in an automatic dishwasher (Miele G 688 SC) according to IKW test protocol (IKW test method; (SOFW, 132 (8), 2006, 35-49) in the flushing program 45° C.-fine. The evaluation took place visually; 0% performance=no tea removal, 100% performance: complete removal of tea soiling. The tests were repeated 3× each and the mean was formed. The pH was measured in the dishwasher during the cleaning process.

The following table shows an overview of the test results after 4 weeks of storage

| granulate | V1 | V2 | 1 |
|---|---|---|---|
| bleaching-performance [%] | 60 | 62 | 90 |

It turned out that the granules coated according to the invention showed a significantly improved performance compared to the uncoated granules or to the granules, which contained a larger amount of sheathing.

Comparative Examples V3 to V5

Comparative Example V3

On a fluidized bed spray granulation system of type Glatt AG400, commercially uncoated bleach activator granules were coated by spraying an aqueous solution of polyvinyl alcohol. Bleaching activator granules without bleaching catalyst were used. The granules contained bleach activator (TAED) as well as the acidic polymer Sokalan® CP 45 (polyacrylate, sodium salt, commercial product of BASF SE). The product Poval® 6-88 (Kuraray commercial product) was used as polyvinyl alcohol. The amount of polyvinyl alcohol was chosen in such a way that the proportion of sheath in the finished product was 3%.

Comparative Example V4

It was worked as in comparison example V3 with the modification that the amount of polyvinyl alcohol was chosen in such a manner that the proportion of sheath in the finished product was 6%.

Comparative Example V5

This was the uncoated bleaching activator granules without bleaching catalyst, which had been used as a starting material in comparative examples V3 and V4.

Application Examples—Bleaching Performance of Coated Granules with Bleaching Activator and without Bleaching Catalyst (MnTACN) with PVOH after Storage 20 g of the IEC-C dishwasher detergent was combined with corresponding amounts of the non-stored granules V3, V4 or V5, so that in each formulation 4 mg bleach activator (calculated as 100% active) were present. The formulations were used to flush 6 teacups (soiled according to ICW test protocol) in an automatic dishwasher (Miele G 688 SC) according to IKW test protocol (IKW test method; (SOFW, 132 (8), 2006, 35-49) in the flushing program 45° C.-fine. The evaluation took place visually; 0% performance=no tea removal, 100% performance: complete removal of tea soiling. The tests were repeated 3× each and the mean was formed. The pH was measured in the dishwasher during the cleaning process.

The table below shows an overview of the test results after 4 weeks of storage at 40° C.:

| granulate | V3 | V4 | V5 |
|---|---|---|---|
| bleaching-performance [%] | 31 | 32 | 32 |

Examples 2, V6 and V7

Example 2

On a fluidized bed spray granulation system of type Glatt AG400, commercially uncoated bleach activator granules were coated by spraying an aqueous solution of polyvinyl alcohol. Bleaching catalyst granules without bleaching activator were used. The granules contained bleaching catalyst (Mn-TACN) as well as sodium sulfate, citric acid and rice starch. The product Poval® 6-88 (Kuraray commerical product) was used as polyvinyl alcohol. The amount of polyvinyl alcohol was chosen in such a way that the proportion of sheath in the finished product was 3%.

Comparative Example V6

It was worked as in example 2 with the modification that the amount of polyvinyl alcohol was chosen in such a manner that the proportion of sheath in the finished product was 6%.

Comparative Example V7

This was the uncoated bleaching catalyst granules without bleaching activator, which had been used as a starting material in example 2 and in comparative example V6.

Application Example—Bleaching Performance of Coated Granules with Bleaching Catalyst (MnTACN) and without Bleaching Activator with PVOH after Storage 20 g of the IEC-C dishwasher detergent was combined with corresponding amounts of the non-stored granules 2, V6 or V7, so that in each formulation 4 mg bleach activator (calculated as 100% active) were present. The formulations were used to flush 6 teacups (soiled according to ICW test protocol) in an automatic dishwasher (Miele G 688 SC) according to IKW test protocol (IKW test method; (SOFW, 132 (8), 2006, 35-49) in the flushing program 45° C.-fine. The evaluation took place visually; 0% performance=no tea removal, 100% performance: complete removal of tea soiling. The tests were repeated 3× each and the mean was formed. The pH was measured in the dishwasher during the cleaning process.

The table below shows an overview of the test results after 4 weeks of storage at 40° C.:

| Granulate | V6 | V7 | 2 |
|---|---|---|---|
| bleaching-performance [%] | 52 | 50 | 92 |

The invention claimed is:

1. Granules containing one or more bleaching catalysts selected from the group of manganese salts or manganese complexes and at least one binder selected from the group of acid organic compounds, the granules being coated with 1 to 3% by weight, referring to the total amount of the granules, with a polyvinyl alcohol-containing coating, wherein the coating comprises at least 80% of polyvinyl alcohol or mixtures thereof, in relation to the total weight of the coating.

2. Granules according to claim 1, characterized in that they contain one or more bleaching activators and one or more bleaching catalysts selected from the group consisting of manganese salts and manganese complexes.

3. Granules according to claim 2, characterized in that these contain, in relation to the total weight of the granules, a) 1 to 90% by weight of one or more bleaching activators, b) 0.01 to 30% by weight of one or more bleaching catalysts selected from the group consisting of manganese salts and manganese complexes, and c) 1 to 30% by weight of one or more binders.

4. Granules according to claim 3, characterized in that they contain, in relation to the total weight of the granules, a) 50 to 85% by weight of one or more bleaching activators, b) 0.1 to 20% by weight of one or more bleaching catalysts selected from the group consisting of manganese salts and manganese complexes, and c) 1 to 20% by weight of one or more binders.

5. Granules according to claim 1, characterized in that they contain, in relation to the total weight of the granules, a) 50 to 85% by weight of one or more bleaching activators, b) 0.1 to 20% by weight of one or more bleaching catalysts selected from the group consisting of manganese salts and manganese complexes;

c) 5 to 20% by weight of a low molecular and/or polymer organic acid, d) 0 to 20% by weight of a binder that is no organic acid according to component c), and e) 1 to 3% by weight of a coating made of polyvinyl alcohol.

6. Granules according to claim 1, characterized in that they contain tetraacetylethylene diamine or decanoyloxy benzoic acid as bleach activators.

7. Granules according to claim 1, characterized in that the bleaching catalysts are selected from the group consisting of manganese sulfate, manganese acetate, manganese oxalate, $[Mn^{III}_2(\mu\text{-}O)_1(\mu\text{-}OAc)_2(TACN)_2](PF_6)_2$, $[Mn^{IV}_2(\mu\text{-}O)_3(Me\text{-}TACN)_2](PF_6)_2$, $[Mn^{IV}_2(M\mu\text{-}O)_3(Me\text{-}TACN)_2](SO_4)$, $[Mn^{IV}_2(\mu\text{-}O)_3(Me\text{-}TACN)_2](OAc)_2$, $[Mn^{IV}_2(\mu\text{-}O)_3(Me\text{-}TACN)_2](Cl)_2$, $[Mn^{IV}_2(\mu\text{-}O)_3(Me4\text{-}DTE)](PF_6)_2$, $[Mn^{IV}_2(\mu\text{-}O)_3(Me4DTE)](Cl)_2$, $[Mn^{IV}_2(\mu\text{-}O)_3(Me4\text{-}DTE)](SO_4)$, $[Mn^{IV}_2(\mu\text{-}O)_3(Me4\text{-}DTE)](OAc)_2$, 1.8-diethyl-1.4.8.11-tetraazacyclotetradecane-manganese (II) chloride and 1.4.8.11-tetraaza-cyclotetradecane-manganese (II) chloride.

8. Granules according to claim 1, characterized in that the bleaching catalysts are selected from the group consisting of mono- or dinuclear complexes of manganese, which have at least one ligand of general formulae A or B Formula A

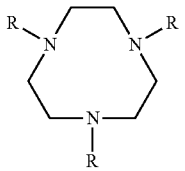

Formula B

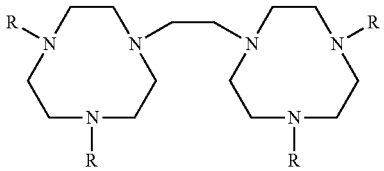

with R=H, $CH_3$, $C_2H_5$, or $C_3H_7$.

9. Granules according claims 1, characterized in that they contain as a binder a homo- or copolymer polycarboxylate.

10. Granules according to claim 1, characterized in that the polyvinyl alcohol has a degree of hydrolysis of 70 to 100 mol % and that its aqueous solution has a viscosity according to Höppler at 20° C., determined according to DIN 53015, of 2 to 70 mPa*s.

11. A method for the production of detergents and cleaning agents utilizing granules according to claim 1.

12. Detergents and cleaning agents containing granules according to claim 1.

13. Detergents and cleaning agents according to claim 12, characterized in that this is an agent for cleaning dishes.

14. Granules according to claim 2, characterized in that they contain tetraacetylethylene diamine or decanoyloxy benzoic acid as bleach activators.

15. Granules according to claim 3, characterized in that they contain tetraacetylethylene diamine or decanoyloxy benzoic acid as bleach activators.

16. Granules according to claim 4, characterized in that they contain tetraacetylethylene diamine or decanoyloxy benzoic acid as bleach activators.

17. Granules according to claim 5, characterized in that they contain tetraacetylethylene diamine or decanoyloxy benzoic acid as bleach activators.

* * * * *